US005524950A

United States Patent [19]

Erickson

[11] Patent Number: 5,524,950

[45] Date of Patent: Jun. 11, 1996

[54] CARRIER FOR BULK MATERIALS

[76] Inventor: Donald P. Erickson, 1751 Scandia Rd., Sister Bay, Wis. 54234

[21] Appl. No.: 433,692

[22] Filed: May 3, 1995

[51] Int. Cl.[6] ..... B65D 71/52

[52] U.S. Cl. ..... 294/169; 294/137

[58] Field of Search ..... 294/27.1, 31.2, 294/32, 137, 141–144, 149–157, 159, 165, 167–169; 220/760, 762–765, 773, 775, 776; 211/13, 49.1, 60.1

[56] References Cited

U.S. PATENT DOCUMENTS

| | | | |
|---|---|---|---|
| 724,492 | 4/1903 | Palmer | 294/169 |
| 778,535 | 12/1904 | Ekholm | 294/169 |
| 926,364 | 6/1909 | Stowe . | |
| 1,091,908 | 3/1914 | Benners | 294/31.2 X |
| 1,118,519 | 11/1914 | Weaver . | |
| 1,314,397 | 8/1919 | Heffron . | |
| 1,722,664 | 7/1929 | Frenning | 294/169 X |
| 1,862,730 | 6/1932 | Wendle | 220/762 X |
| 1,971,322 | 8/1934 | Miller . | |
| 2,144,661 | 1/1939 | Nelson | 220/762 |
| 2,334,595 | 11/1943 | Bailey | 294/169 X |
| 2,459,865 | 1/1949 | Bourne . | |
| 2,598,710 | 6/1952 | Murphy | 294/169 X |
| 2,848,149 | 8/1958 | Ward | 294/152 X |
| 2,973,218 | 2/1961 | Schaum . | |
| 3,346,157 | 10/1967 | Haney | 294/142 |
| 3,613,552 | 5/1970 | Kean . | |
| 4,140,257 | 2/1979 | Peterson . | |
| 4,235,331 | 11/1980 | Bates et al. | 294/169 X |
| 4,626,015 | 12/1986 | Kruyt . | |
| 4,759,578 | 7/1988 | Gonzalez . | |

FOREIGN PATENT DOCUMENTS

| | | | |
|---|---|---|---|
| 78080 | 8/1933 | Sweden | 294/169 |
| 89326 | 5/1937 | Sweden | 294/169 |
| 869651 | 6/1961 | United Kingdom | 294/152 |

*Primary Examiner*—Johnny D. Cherry
*Attorney, Agent, or Firm*—Foley & Lardner

[57] ABSTRACT

A carrier for bulk materials includes a substantially flat bottom, upstanding side members and a handle assembly. The side members are spaced apart and arranged in mutually facing relation, creating an open volume therebetween in which firewood or similar articles may be stacked and carried. The bottom and the side members are generally rigid, whereby the carrier may be stood upright for charging, transport, storage and discharging. The bottom and side members are preferably formed integrally with one another, such as by injection molding, to create a strong, rigid, unitary structure. The handle, preferably made of a stiff wire, is added after fabrication of the bottom and side members. The handle can be pivoted on the side members or locked into an upright position.

7 Claims, 1 Drawing Sheet

CARRIER FOR BULK MATERIALS

BACKGROUND OF THE INVENTION

The present invention relates generally to a carrier for bulk materials. More particularly, the invention relates to a novel carrier for bulk materials such as firewood having a substantially rigid construction with upstanding side members.

Carriers for bulk materials such as firewood are generally known in the art. Known carriers of this type, however, generally consist of a flexible bottom or of flexible side members, or of both. By way of illustration, U.S. Pat. No. 4,626,015 to Kruyt, entitled "Firewood Carrier," shows a carrier with rigid combined sides and handles that are secured to a flexible base support member. U.S. Pat. No. 1,971,322 to Miller, entitled "Article Carrier," shows a sling for supporting a bundle of firewood, substantially consisting of a flattened, flexible paper tube. U.S. Pat. No. 1,118,519 to Weaver, entitled "Wood Carrier," describes crossbars flexibly interconnected by a series of chain links, secured to handles at opposed ends. In operation, each of these carriers rely upon the flexibility of the bottom or of one or more members to secure and restrain the bulk material that is to be carried.

U.S. Pat. No. 4,140,257 to Peterson, entitled "Trash Bag Sling," consists of a series of flexible straps connected to a rigid reinforcing bottom plate. However, as is true for the arrangements disclosed in the Kruyt, Miller, and Weaver patents, the sling disclosed in the Peterson patent relies upon the flexibility of one or more members (i.e., the straps) to secure and restrain the bulk material to be carried.

Other commercially available firewood carriers include a bent or curved metal shell wherein firewood can be stacked. A handle is generally rigidly fixed to the shell for lifting the carrier. However, to lend sufficient rigidity to the resulting carrier, the metal shells of such carriers tend to be rather heavy structures, thereby limiting the amount of firewood a user can stack and carry comfortably. Moreover, the metal shell in such carriers must be formed by relatively expensive metal forming operations, such as stamping. In addition, due to the curved configuration of such carriers, a separate base or feet may be required to prevent the carrier from tipping or rocking during loading and unloading.

There is a need, therefore, for an improved carrier for bulk materials such as firewood and the like that can be easily loaded, transported and unloaded. In particular, there is a need for such a carrier that is both lightweight and rigid, thereby permitting more material to be carried in each load while adequately resisting loading forces created by the bulk material. In addition, there is a need for a carrier of the type described that can be easily and economically manufactured and assembled.

SUMMARY OF THE INVENTION

The present invention features a carrier for bulk materials consisting of a substantially rigid, preferably flat bottom and of substantially rigid, generally vertical, upstanding side members. The present invention also features a handle attachment by which the carrier and bulk materials placed therein may be carried.

In accordance with a particularly preferred embodiment, the carrier is constructed of an injection moldable plastic material, or the like, and the substantially rigid bottom and substantially rigid upstanding side members comprise a single unit. In this preferred embodiment, the carrier also comprises a handle attachment pivotally interconnected to each substantially rigid upstanding side member at an aperture formed within a support. In this embodiment, the carrier further comprises a notch in the upper edges of the upstanding side members which receives and restrains the handle attachment in a upright position, to allow bulk materials such as firewood freely to be loaded into or unloaded from the carrier without obstruction. Other advantageous features of the invention are described in greater detail below.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Figure 1:
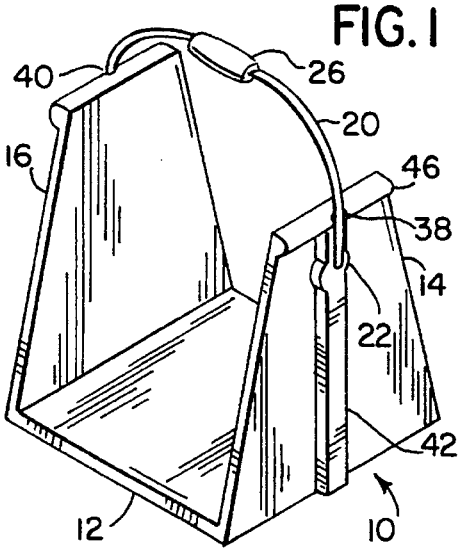
FIG. 1 is a perspective view of a carrier for bulk materials in accordance with an exemplary embodiment of the present invention.

Turning now to the drawings and referring to FIG. 1, the carrier 10 includes a substantially rigid, generally flat bottom 12 and two substantially rigid, generally vertical, upstanding side members 14 and 16 extending from bottom 12. Side members 14 and 16 are substantially parallel to one another and are spaced apart by the width of bottom 12 in mutually facing relation. Side members 14 and 16 preferably join bottom 12 at a relatively steep angle, such as 90°, to allow for efficient stacking of materials in carrier 10 as discussed below. The outwardly-oriented surfaces of side members 14 and 16 include corresponding handle attachment supports 22 and 24 for a generally semicircular handle attachment 20. As shown in FIG. 1, handle attachment 20, preferably made of a stiff wire, contains a centrally-placed handle bead 26 which can be grasped for lifting carrier 10.

Figure 2:
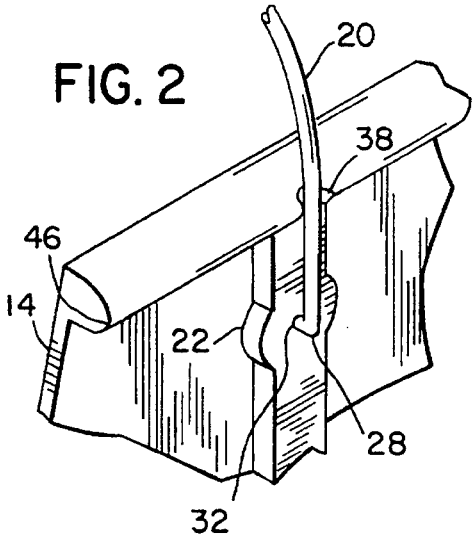
FIG. 2 is a perspective view of the carrier for bulk materials illustrated in FIG. 1, showing in detail the handle attachment support.

At each end of handle attachment 20 are bends 28 and 30 (see FIG. 4) by which handle attachment 20 is rotatably received within supports 22 and 24. More specifically, as shown in FIG. 2, a portion of handle attachment 20 extending from bend 28 toward a corresponding side member 14 is received in an aperture 32 of substantially circular cross-section within support 22. Handle attachment 20 thereby can pivot within apertures 32 and 34 about supports 22 and 24.

Each of the side members 14 and 16 also includes semi-circular handle attachment notches 38 and 40 for receiving and retaining handle attachment 20 in a substantially upright position, as shown in detail in FIG. 2. In the preferred embodiment shown in FIG. 2, because the width of handle attachment 20 in the region of bends 28 and 30 is slightly less than the distance between side members 14 and 16 at notches 38 and 40, handle attachment 20 is received and retained by the geometry of notches 38 and 40 and further by the slight compression of side members 14 and 16 by handle attachment 20, with corresponding reaction forces from the side members. Handle attachment 20 is disengaged from notches 38 and 40 and may thus be swung to a lowered position by slightly pressing each of the side members 14 and 16 inward (toward one another) at or near the location of the notches 38 and 40 to a distance less than the opening of the handle attachment and with sufficient force to overcome the reaction forces.

Figure 3:
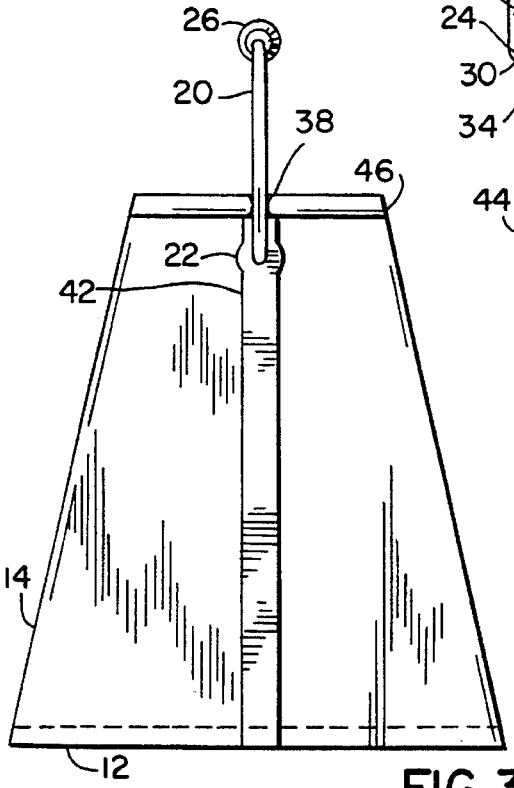
FIG. 3 is a side view of the carrier for bulk materials of FIG. 1.

In accordance with this embodiment, bottom 12 and side members 14 and 16, with handle attachment supports 22 and 24, are preferably made of an injection moldable plastic, and are conveniently formed in a single unit. Each of the side members 14 and 16 preferably has an trapezoidal profile, as shown in FIG. 3, and may be formed with central vertical ribs 42 and 44, which extend from the respective handle supports 22 and 24 downward to bottom 12. Vertical ribs 42 and 44 lend rigidity to carrier 10. A typical configuration for these ribs is shown for side member 14 in FIG. 3. Handle supports 22 and 24 may be formed integrally and contiguous with corresponding ribs 42 and 44, as shown in FIGS. 2 and 3. Moreover, where additional stiffening of side members 14 and 16 is desired, a plurality of ribs 42 and 44 may be provided on each side member.

Figure 4:
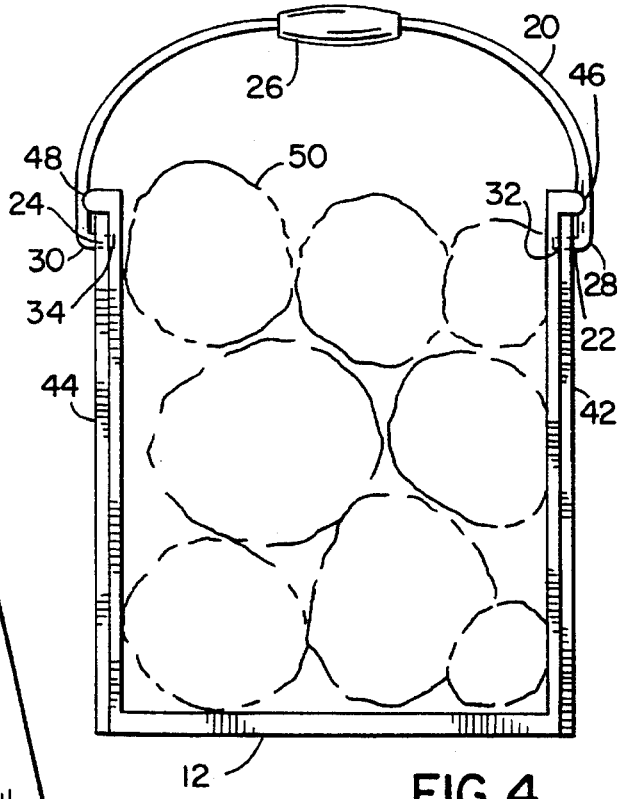
FIG. 4 is a front view of the carrier for bulk materials of FIG. 1, illustrating how the carrier would typically be loaded with firewood or similar materials.

Each of the exposed upper edges of side members 14 and 16 may be formed to create ledges 46 and 48, into which notches 38 and 40 may be formed, as shown in FIGS. 1, 3 and 4. This configuration is shown in detail for one side member 14 in FIG. 2.

In use, firewood 50 or similar objects or materials may be placed and stacked on bottom 12 between side members 14 and 16, as shown in FIG. 4. Because the end regions between side members 14 and 16 are open, materials placed in carrier 10 can extend beyond the bounds of the side members. Moreover, due to the rigidity of bottom 12 and side members 14 and 16, carrier 10 remains in an upright position during charging, transport and discharging. Once loaded, handle attachment 20, received in notches 38 and 40 in an upright position above the firewood 50, can be grasped for transporting carrier 10 and firewood 50. Carrier 10 thus serves both as a carrier for bulk materials such as firewood 50 and as a storage bin for such materials.

While the construction and arrangement of the carrier as illustrated in the accompanying drawings is that of a generally preferred form, modifications and changes may be made without departing from the spirit of the invention and scope of the claims.

I claim:

1. A carrier for bulk materials comprising:

a substantially rigid bottom;

a pair of substantially rigid, generally vertical upstanding and spaced apart side members attached to and formed integrally with the bottom from a moldable plastic material, the side members and bottom forming an open ended carrier body for receiving bulk materials, each side member including at least one generally vertical rigidifying rib and a support for receiving a movable handle; and a handle attachment pivotally received within the supports of the side members.

2. The carrier of claim 1, wherein each side member includes an upper ledge including a notch for receiving and retaining the handle attachment in a substantially upright position.

3. The carrier of claim 1, wherein the bottom is substantially flat.

4. The carrier of claim 1, further comprising a lifting handle positioned on the handle attachment to facilitate transport of the carrier.

5. The carrier of claim 1, wherein each side member includes an aperture for pivotally receiving and retaining an end of the handle attachment.

6. A carrier for bulk materials such as firewood comprising:

an open ended, molded plastic carrier body including a substantially rigid bottom section and a pair of upstanding, spaced apart and mutually facing side sections formed integrally with the bottom section, each side section including at least one substantially vertical rigidifying rib formed integrally therewith; and a handle pivotally coupled to the side sections for lifting and transporting the carrier.

7. A carrier as set forth in claim 6, wherein each side section includes an upper ledge, a notch being formed in each upper ledge for releasably receiving the handle and maintaining the handle in a carrying position.

* * * * *